United States Patent [19]

Dohi

[11] Patent Number: 5,025,554

[45] Date of Patent: Jun. 25, 1991

[54] METHOD OF CONNECTING A CRIMP-STYLE TERMINAL TO ELECTRICAL CONDUCTORS OF AN ELECTRICAL WIRE

[75] Inventor: Hikoo Dohi, Shizuoka, Japan

[73] Assignee: Yazalci Corporation, Tokyo, Japan

[21] Appl. No.: 559,454

[22] Filed: Jul. 25, 1990

Related U.S. Application Data

[63] Continuation of Ser. No. 376,737, Jul. 7, 1989, abandoned.

[30] Foreign Application Priority Data

Jul. 8, 1988 [JP] Japan ..... 63-168963

[51] Int. Cl.[5] ..... H01R 43/02

[52] U.S. Cl. ..... 29/860; 174/94 R; 439/877

[58] Field of Search ..... 29/860, 865; 174/94 R; 439/877, 878

[56] References Cited

U.S. PATENT DOCUMENTS

| | | | |
|---|---|---|---|
| 2,022,544 | 11/1935 | Huber | 439/877 X |
| 2,494,137 | 1/1950 | Martines | 29/860 |
| 2,586,471 | 2/1952 | Matthysse | 439/877 |
| 2,909,758 | 10/1959 | Modrey | 174/94 R |
| 3,346,690 | 10/1967 | McNerney | 174/94 R X |
| 3,436,946 | 8/1969 | Grupp et al. | 72/379.2 X |
| 3,443,256 | 5/1969 | Holton et al. | 174/94 R X |
| 3,519,982 | 7/1970 | White . | |
| 4,277,886 | 7/1981 | Bauer et al. | 29/860 |

FOREIGN PATENT DOCUMENTS

| | | |
|---|---|---|
| 2008021 | 9/1970 | Fed. Rep. of Germany . |
| 3047684 | 2/1984 | Fed. Rep. of Germany . |

*Primary Examiner*—Carl J. Arbes

*Attorney, Agent, or Firm*—Sughrue, Mion, Zinn, Mcpeak & Seas

[57] ABSTRACT

A method of forming a crimp-style terminal and the resulting crimp-style terminal. A solder cream is applied to one or both of the inner surface of the conductor-holding portion of the terminal and the conductor wires which are to be held by the conductor-holding portion. The conductor-holding portion is subsequently deformed by pressing to grip the wire conductors. The solder cream fills the space between the conductor bundle and the inner surface of the conductor-holding portion and the space between conductors of the conductor bundle.

8 Claims, 2 Drawing Sheets

METHOD OF CONNECTING A CRIMP-STYLE TERMINAL TO ELECTRICAL CONDUCTORS OF AN ELECTRICAL WIRE

This is a continuation of application Ser. No. 07/376,737, filed July 7, 1989, now abandoned.

BACKGROUND OF THE INVENTION

1. Field of the Invention

This invention relates to a conductor-connecting construction of a crimp-style terminal, and more particularly to such a crimp-style terminal which can be connected to the conductors in a highly reliable manner.

2. Prior Art

As shown in FIG. 4, a conventional crimp-style terminal of the general type includes a contact portion 1, a conductor-holding portion 2 extending from the contact portion 1, and a sheath-holding portion 3 extending from the conductor-holding portion 2. The conductor-holding portion 2 is in the form of a plate which has a base extending from the contact portion 1, and a pair of clamp arms 2*a* extending laterally respectively from the opposite sides of the base. The pair of clamp arms 2*a* are bent upwardly and further curved inwardly at their ends so as to hold or clamp conductors 4 of a wire W. The sheath-holding portion 3 is similar in shape to the conductor-holding portion 2, and has a pair of clamp arms 3*a* for holding the wire W having a sheath 5.

For electrically connecting the crimp-style terminal to the wire W, the conductors 4 from which the sheath 5 is removed are received in the conductor-holding portion 2, and the wire W having the sheath 5 is received in the sheath-holding portion 3. Then, the pair of clamp arms 2*a* as well as the pair of clamp arms 3*a* are pressed by a pair of upper and lower dies 8 and 8', as shown in FIG. 5. As a result, the clamp arms 2*a* are deformed so as to come into intimate contact with the conductors 4, and even after the dies 8 and 8' are brought out of contact with the clamp arms 2*a*, the residual resilient force present in the thus deformed clamp arms 2*a* keeps the clamp arms in contact with the conductors 4.

When the force of contact between the clamp arms 2*a* and the conductors 4 is insufficient, such contact is inadequate so that the electrical resistance between the conductor-holding portion 2 and the conductors 4 increases to cause adverse effects such as heating and burning. In such a case, also, this connection may be loosened and broken upon application of an external force, which leads to a malfunction of equipment to which the terminal is connected, or stops the operation of such equipment. Therefore, it is necessary to strictly control dimensional accuracies of the conductor-holding portion 2.

Each of the conductors 4 has a generally circular cross-section, and therefore many gaps 6 are formed between the conductor-holding portion 2 and the conductors 4 and also between the conductors 4. As a result, oxide films or the like are formed on the outer surfaces of the conductors 4 and also on the inner surface of the conductor-holding portion 2, and the electrical resistance increases with time, which may result in an imperfect contact. Also, it is possible that such imperfect contact causes heating and burning of the wire (that is, the insulator portion).

To overcome such imperfect contact, it has been proposed to solder the conductor-holding portion and the conductors either by a soldering iron or by dipping them in a bath of molten solder. Such soldering operation is performed on a large scale, and additional time is required.

SUMMARY OF THE INVENTION

It is therefore an object of this invention to provide a conductor-connecting construction of a crimp-style terminal which overcomes the above deficiencies of the prior art, and can provide a firm connection between the terminal and the conductors, and is reliable in operation over a prolonged period of time.

According to a first aspect of the present invention, there is provided a method of connecting a crimp-style terminal to electrical conductors of an electrical wire, comprising the steps of:

applying a solder cream to the inner surfaces of a conductor-holding portion of the terminal or to outer surfaces of the conductors;

subsequently deforming the conductor-holding portion by a pressing operation so that the conductor-holding portion embraces the conductors; and subsequently melting and then solidifying the solder cream.

According to a second aspect of the present invention, there is provided a conductor-connecting construction of a crimp-style terminal comprising:

a contact portion;

a conductor-holding portion in the form of a plate which has a first base extending from the contact portion and a pair of first clamp arms extending laterally respectively from the opposite sides of the base, the pair of clamp arms being bent upwardly and further curved inwardly at their ends to hold electrical conductors of an electrical wire;

a sheath-holding portion in the form of a plate which has a second base extending from the conductor-holding portion away from the contact portion, and a pair of second clamp arms extending laterally respectively from the opposite sides of the second base, the pair of second clamp arms being bent upwardly and further curved inwardly at their ends to hold the wire having a sheath; and a solder cream interspersed among the conductors, and together filling a space defined by the first clamp arms and the first base of the conductor-holding portion, the solder cream in the space being first melted and then solidified.

DESCRIPTION OF THE PREFERRED EMBODIMENT OF THE INVENTION

The invention will now be described with reference to the drawings.

Figure 1:
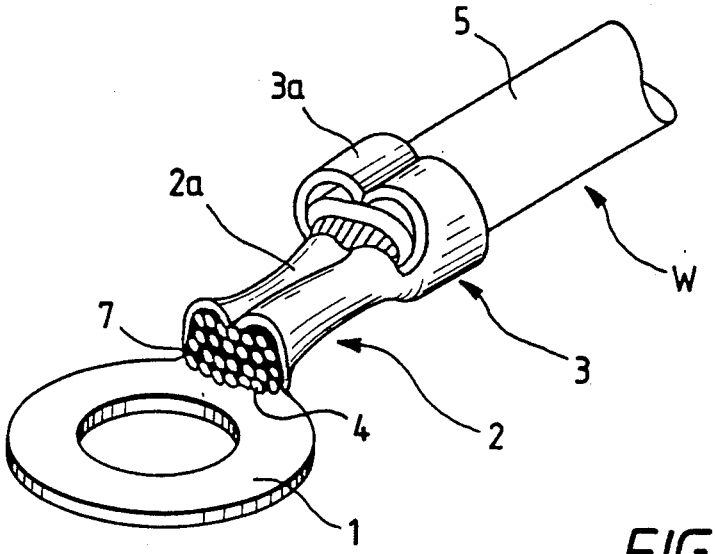
FIG. 1 is a perspective view of a crimp-style terminal connected to an electrical wire, provided in accordance with the present invention.
Figure 2:
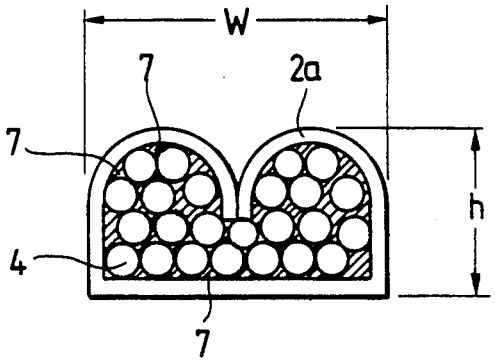
FIG. 2 is a cross-sectional view of a conductor-holding portion of the terminal.

FIGS. 1 and 2 show a conductor-connecting construction of a crimp-style terminal. The crimp-style terminal includes a contact portion 1, a conductor-holding portion 2 extending from the contact portion 1, and a sheath-holding portion 3 extending from the conductor-holding portion 2 away from the contact portion 1. The conductor-holding portion 2 is in the form of a plate which has a base extending from the contact portion 1, and a pair of clamp arms 2*a* extending laterally respectively from the opposite sides of the base. The pair of clamp arms 2*a* are bent upwardly and further curved inwardly at their ends so as to hold or clamp conductors 4 of a wire W. The sheath-holding portion 3 is similar in shape to the conductor-holding portion 2, and has a pair of clamp arms 3*a* for holding the wire W having a sheath 5.

Figure 4:
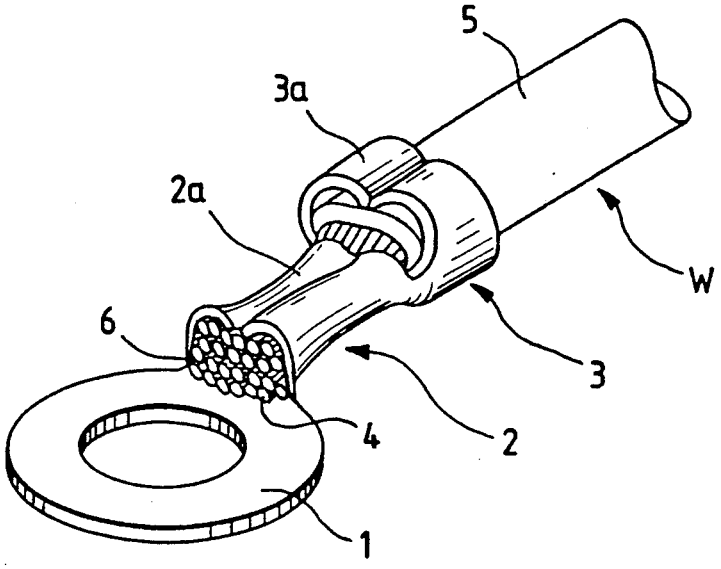
FIG. 4 is a view similar to FIG. 1, but showing the prior art.
Figure 5:
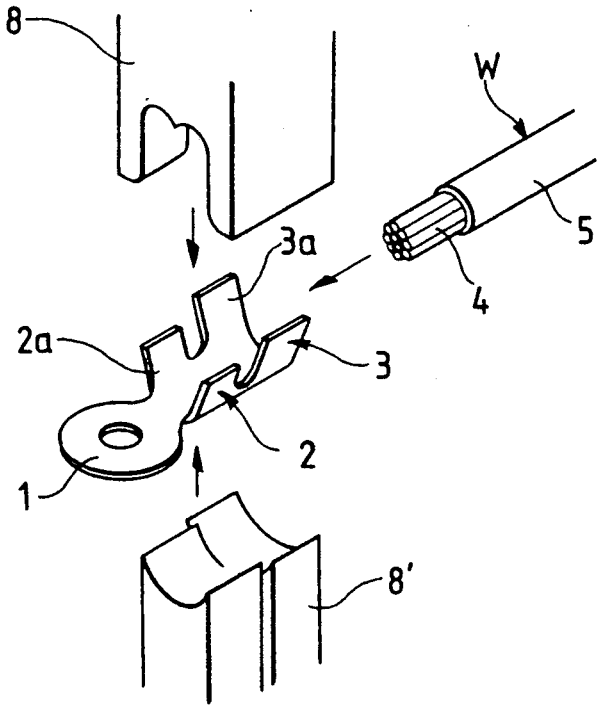
FIG. 5 is a view similar to FIG. 3, but showing the operation of the prior art of FIG. 4.

As shown in FIGS. 1 and 2, a solder cream 7 in its solidified or set condition fills in the gaps 6 (see FIG. 4) between the conductors 4 of the wire W and also between the inner surface of the conductor-holding portion 2 and the conductors; the solder cream 7 having been first melted and then solidified.

Figure 3:
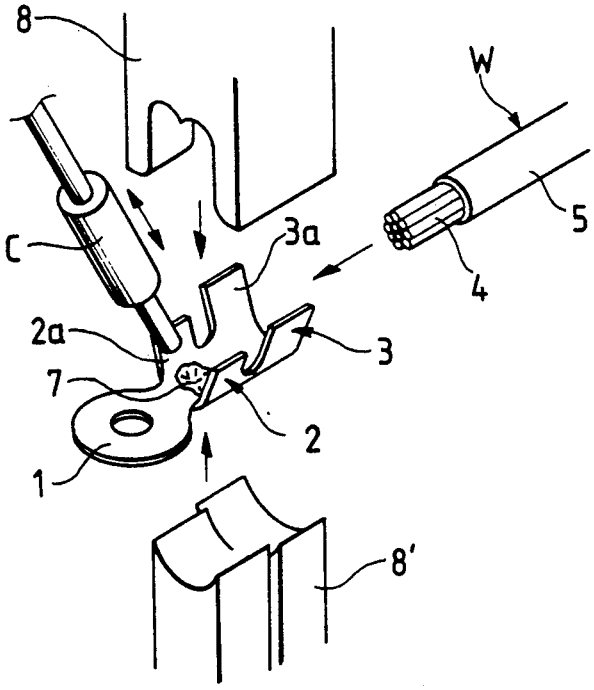
FIG. 3 is a perspective view showing a terminal-fastening fastening operation.

As shown in FIG. 3, the solder cream 7 is first coated or applied to the inner surface of the conductor-holding portion 2 and the outer surfaces of the conductors 4. Then, the conductors 4 are received in the conductor-holding portion 2, and the conductor-holding portion 2 is deformed by a pair of dies 8 and 8' in the known manner, so that the conductor-holding portion 2 embraces and retains the conductors 4. Thereafter, the solder cream 7 is melted to completely fill the gaps 6 and then is solidified or set.

The solder cream 7 is formed by mixing particles of a solder alloy, a flux, such as active rosin, and a solvent into a paste form. The solder alloy in the form of particles is made mainly either of tin and lead or of tin and bismuth. The solder cream 7 has excellent adhesive properties, and a commercially-available tube of such solder cream can be used in its original condition.

As shown in FIG. 3, the solder cream 7 is coated on both the conductor-holding portion 2 and the conductors 4. Alternatively, the conductor-holding portion 2 is placed on the die 8', and then the solder cream 7 is applied from a tube C to the conductor-holding portion 2. After the conductor-holding portion 2 is deformed by the dies 8 and 8' in the known manner, the thus deformed conductor-holding portion 2 holding the conductors 4 is subjected to a low-temperature heat treatment at a temperature of around 180° C., so that the above-mentioned solder alloy melts to completely fill the gaps 6 between the conductors 4 and also between the conductor-holding portion 2 and the conductors 4.

An ordinary solder incorporating a flux may be secured beforehand to the inner surface of the conductor-holding portion 2.

As shown in FIG. 2, the gaps 6 between the conductor-holding portion 2 and the conductors 4 are filled with the solder cream 7, so that the conductor-holding portion 2 and the conductors 4 are joined together, thereby providing a good electrical conductor as a whole. Therefore, the problems of the conductors coming loose relative to the conductor-holding portion 2, the disengagement of the conductors from the conductor-holding potion, and an imperfect contact therebetween, are eliminated even if the holding force of the conductor-holding portion 2 is inadequate.

Since the gaps 6 are filled with and closed by the solder cream 7, the conductors 4 are isolated from the ambient atmosphere. This prevents the formation of oxide films and the increase of electrical resistance with the passage of time. As a result, the need for strict control of the dimensional accuracies of the barrel width w and the height h of the conductor-holding portion 2 can be reduced.

Further, the melting of the solder cream 7 can be effected merely by the low-temperature heat treatment, and in addition such heat treatment does not provide adverse thermal effects on the sheath 5.

As described above, the conductor-connecting construction of the crimp-style terminal according to the present invention can be easily achieved merely by adding the coating of the solder cream and the low-temperature heat treatment to a conventional terminal-fastening operation. With this construction, an electrical connection which is reliable and stable can be obtained without lowering the efficiency of the terminal-fastening operation. In addition, because of the solder cream filling the gaps and the setting (solidification) of the solder cream, a positive mechanical holding of the conductors by the conductor-holding portion as well as a good electrical contact therebetween can be achieved even if the control of the manufacturing tolerances of the conductor-holding portion is not so strict. Therefore, the conductor-connecting construction can provide good performance over a prolonged period of time even in bad environments.

What is claimed is:

1. A method of connecting a crimp-style terminal to electrical conductors of an electrical wire, said crimp-style terminal being of the type having a conductor-holding portion, said conductor-holding portion comprising a base and a pair of clamp arms extending laterally respectively from opposite sides of said base, comprising the steps of:

applying a solder cream to one or both of the inner surfaces of said conductor-holding portion and the outer surfaces of said conductors;

subsequently deforming said conductor-holding portion by pressing and bending said pair of clamp arms upwardly and further curving said pair of clamp arms inwardly at end portions thereof so as to cause said conductor-holding portion to cover and grip said conductors such that gaps are formed between said conductors, said solder cream filling said gaps; and subsequently melting and then solidifying said solder cream.

2. A method according to claim 1, wherein said deforming step comprises deforming said conductor-holding portion by the use of dies.

3. A method according to claim 1, wherein said solder cream is applied to the inner surfaces of said conductor-holding portion after said terminal is placed on said die for deforming said conductor-holding portion.

4. A method according to claim 1, wherein said solder cream is applied to the inner surfaces of said conductor-holding portion before said terminal is placed on said die for deforming said conductor-holding portion.

5. A method according to claim 1, in which said solder cream is a mixture of tin and lead with a flux and a solvent.

6. A method according to claim 1, in which said solder cream is formed by mixing tin and bismuth with a flux and a solvent.

7. A method according to claim 1, in which a solder incorporating a flux is secured to said conductor-holding portion.

8. A method according to claim 1, wherein said melting step comprises subjecting the deformed conductor-holding portion gripping said conductors to a low-temperature heat treatment at a temperature of approximately 180° C., such that said solder cream melts to fill gaps between said conductors and also between said conductor-holding portion and said conductors.

* * * * *